US006750606B2

(12) United States Patent
Kenmotsu

(10) Patent No.: US 6,750,606 B2
(45) Date of Patent: Jun. 15, 2004

(54) GATE-TO-ELECTRODE CONNECTION IN A FLAT PANEL DISPLAY

(75) Inventor: Hidenori Kenmotsu, San Jose, CA (US)

(73) Assignees: Sony Corporation (JP); Sony Electronics, Inc., Park Ridge, NJ (US)

( * ) Notice: Subject to any disclaimer, the term of this patent is extended or adjusted under 35 U.S.C. 154(b) by 140 days.

(21) Appl. No.: 09/947,288

(22) Filed: Sep. 5, 2001

(65) Prior Publication Data

US 2003/0042840 A1 Mar. 6, 2003

(51) Int. Cl.[7] ..... H01J 19/24; H01J 9/02

(52) U.S. Cl. ..... 313/495; 313/497; 313/309; 313/311; 313/336; 445/24; 445/50; 345/76

(58) Field of Search ..... 313/495, 497, 313/308–311, 331, 336; 445/24, 29, 25, 50; 345/76, 75.2; 315/169.1, 169.3

(56) References Cited

U.S. PATENT DOCUMENTS 5,578,896 A * 11/1996 Huang ..... 313/309
5,632,664 A * 5/1997 Scoggan et al. ..... 445/50
5,669,801 A * 9/1997 Lee ..... 445/24
5,717,285 A * 2/1998 Meyer et al. ..... 313/495
5,723,052 A * 3/1998 Liu ..... 216/25
5,895,580 A * 4/1999 Liu et al. ..... 216/11
6,509,686 B1 * 1/2003 Moradi et al. ..... 313/495

* cited by examiner

*Primary Examiner*—Ashok Patel
*Assistant Examiner*—Sikha Roy
(74) *Attorney, Agent, or Firm*—Rader, Fishman & Grauer PLLC; Ronald P. Kananen

(57) ABSTRACT

A flat panel display and manufacturing method therefor is provided having a baseplate hermetically sealed to a faceplate. A first electrode and a resistive layer are formed on the baseplate. An insulating layer is deposited on the resistive layer. A second electrode is formed over the insulating layer. A passivation layer is deposited over the insulating layer and a gate is formed over the passivation layer. Openings are concurrently formed in the gate and insulation layer and used to form an emitter cavity. A conductive glue is deposited to form a gate-to-electrode contact for connecting the gate and the second electrode. An emitter is formed in the emitter cavity and emitter material outside of the emitter cavity is removed.

20 Claims, 3 Drawing Sheets

GATE-TO-ELECTRODE CONNECTION IN A FLAT PANEL DISPLAY

TECHNICAL FIELD

The present invention relates generally to field emission displays and more particularly to connection of a gate to an electrode.

BACKGROUND ART

The cathode ray tube (CRT) display has been the predominant display technology for purposes such as home television and computer systems. For many applications, the CRT display has advantages in terms of superior color resolution, high contrast and brightness, wide viewing angles, fast response times, and low manufacturing costs. However, the CRT display also has major drawbacks such as excessive bulk and weight, fragility, high power and voltage requirements, strong electromagnetic emissions, the need for implosion and x-ray protection, undesirable analog device characteristics, and a requirement for an unsupported vacuum envelope that limits screen size.

To address the inherent drawbacks of the CRT display, alternative display technologies have been developed. These technologies generally provide a flat panel display, and include the liquid crystal display (LCD), both passive and active matrix, the electroluminescent display (ELD), the plasma display panel (PDP), the vacuum fluorescent display (VFD) and the field emission display (FED).

The FED offers great promise as an alternative flat panel display technology. Its advantages include low cost of manufacturing as well as the superior optical characteristics generally associated with the CRT display technology. Like the CRT display, the FED is phosphor based and relies on cathodoluminescence as a principle of operation. The FED relies on electric field or voltage induced emissions to excite the phosphors by electron bombardment rather than the temperature induced emissions used in the CRT display. To produce these emissions, the FED has generally used row-and-column addressable cold cathode emitters of which there are a variety of designs, such as point emitters (also called cone, microtip, or "Spindt" emitters), wedge emitters, thin film amorphic diamond emitters, and thin film edge emitters.

Each of the FED emitters is typically a miniature electron gun of micron dimensions. An insulator and a resistor separate the row electrode from a column electrode, and the column electrode is connected to a gate. An opening is formed in the gate, and an emitter cavity is formed in the insulator down to the resistor. The opening is used to deposit the emitter in the emitter cavity so that the tip of the emitter is adjacent the gate. When a sufficient voltage is applied between the emitter, coupled by the resistor to the row electrode, and an adjacent gate, electrons are emitted from the emitter into a low-pressure environment, which is located between a baseplate, upon which the emitters are mounted, and a faceplate having a metal anode surface over color phosphors. The emitted electrons are attracted to the anode cause the phosphors to emit visible light which form picture elements, or pixels, which make up the images on the face of the FED.

In one FED, a column electrode provides voltage to a gate and a row electrode imposes a voltage on an emitter. In the past, extra steps were required to specifically make the connection between the gate and the column electrode. Generally, a passivation layer over the column electrode needed to be masked and etched specifically for the connection and a high-selectivity etch process was required for etching the passivation layer to avoid undesirable etching of the dielectric layer which was also exposed to the etchant.

The large number of steps required to manufacture a baseplate have long been accepted and a method for simplifying the manufacture has long eluded those skilled in the art.

DISCLOSURE OF THE INVENTION

The present invention provides a flat panel display in which a contact is made between a gate and an emitter electrode using the emitter formation steps and a conductive glue used to secure the emitter. This provides a simplified flat panel display baseplate.

The present invention further provides a method of manufacturing a flat panel display in which a connection between a gate and emitter electrode is formed as part of the conductive glue deposition prior to emitter deposition. This simplifies and speeds up the manufacturing of field emission displays.

The above and additional advantages of the present invention will become apparent to those skilled in the art from a reading of the following detailed description when taken in conjunction with the accompanying drawings.

BEST MODE FOR CARRYING OUT THE INVENTION

Figure 1:
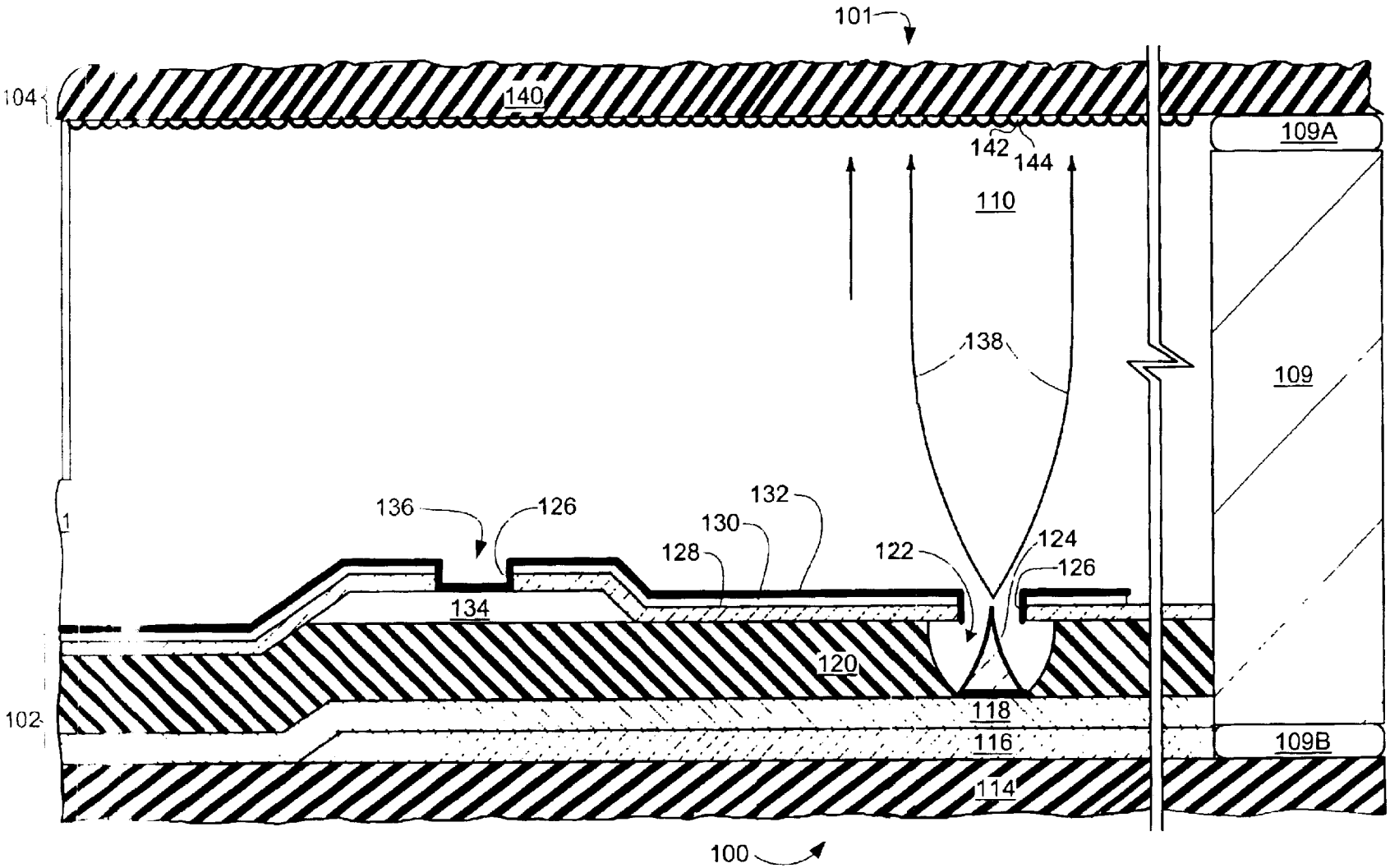
FIG. 1 is a cross-section of a portion of a flat panel display incorporating the present invention.

Referring now to FIG. 1, therein is shown a close-up cross-section of a portion of a flat panel display, such as a field emission display (FED) 100 for a single picture element, or pixel 101. The FED 100 includes a baseplate 102 and a faceplate 104 separated by a focus plate 106 and a wall spacer 108, and sealed by a hermetic seal 109 with frit 109A and 109B fusing the hermetic seal 109 to the baseplate 102 and the faceplate 104. The space between the baseplate 102 and the faceplate 104 contains a low-pressure environment 110 at about $10^{-7}$ torr.

The baseplate 102 includes an insulating plate 114 upon which a plurality of parallel row electrodes, such as a row electrode 116, has been deposited. A resistive layer 118 is deposited on the row electrode 116 and is covered by an insulating layer 120 which has an emitter cavity 122 formed therein. Inside the emitter cavity 122 is an electron emissive element such as an emitter 124. A plurality of cavities and electron emissive elements are formed within one pixel area. The emitter 124 is deposited on a conductive glue 132 on the resistive layer 118 in the emitter cavity 122 and is concentric with one of a plurality of concurrently formed openings 126 patterned into an upper base electrode, which is made up successively of a passivation layer 128, a plurality of gates, such as a gate 130, and the conductive glue 132 over the insulating layer 120. The term "patterned" as used herein photolithographic processing and development process, which is well known in the art of semiconductor manufacturing.

In accordance with the present invention, the gate 130 is deposited over the insulating layer 120 and under the conductive glue 132, which connects the gate 130 to one of a plurality of column electrodes, such as a column electrode 134, at a gate-to-electrode contact 136. The labels "row" and "column" electrodes are used as a matter of convenience to designate the groups of parallel linear electrodes, which extend perpendicular to each other, and the designations can be interchanged or different.

The faceplate 104 includes a transparent plate 140 of a material, such as glass or plastic, coated with phosphors 142 having a thin electrode 144 of a material such as aluminum deposited over them.

The hermetic seal 109 is glass or plastic and the frit 109A and 109B, respectively bonding to the faceplate 104 and the baseplate 102, is of an aluminum and lead compound or other low melting point compound which will adhere to the glass or plastic.

The row electrode 116 and the column electrode 134 are composed of a conductive material such as aluminum (Al) or nickel (Ni), with a protective cladding (not shown) of a material such as tantalum (Ta) or titanium (Ti).

The resistive layer 118 is composed of a material, such as silicon carbide (SiC) or amorphous silicon, with a ceramic-metal (cermet) cladding of a material, which is a mixture of chromium in silicon oxide (Cr—$SiO_x$). The resistive layer 118 acts as a ballast to provide for uniformity of electron emission from the emitter 124 in addition to providing other ancillary features during manufacture and operation such as acting as an etch stop for the emitter cavity 122 and providing short-circuit protection between the row electrode 116 and the emitter 124.

The insulating layer 120 is a conventional semiconductor interlayer dielectric (ILD) material, such as silicon oxide ($SiO_x$), and the gate 130 is made of a fairly dense metal, such as chromium (Cr), which is resistant to electron impact. The emitter 124 is of a material such as molybdenum (Mo) and the conductive glue 132 is of a material such as chromium, which will bond the emitter 124 to the resistive layer 118.

In operation, the baseplate 102 is charged to become the cathode and the faceplate 104 is charged to become the anode. More specifically, a negative voltage is imposed on the row electrode 116. The negative voltage is imposed through the resistive layer 118 to the emitter 124. A positive voltage is imposed on the thin electrode 144. When a suitable voltage, generally around 10 volts more positive than the voltage on the emitter 124, is applied to the gate 130, the emitter 124 emits electrons into the low-pressure environment 110 at various angles. The emitted electrons, under the influence of electric fields from the focus plate 106, follow parabolic trajectories indicated by lines 138 to impact on the thin electrode 144, which has the anode voltage impressed upon it. The phosphors 142 behind the thin electrode 144 struck by the emitted electrons will produce light of a color consistent with a particular phosphor selected. The light will be for one picture element, or pixel 101.

Figure 2:
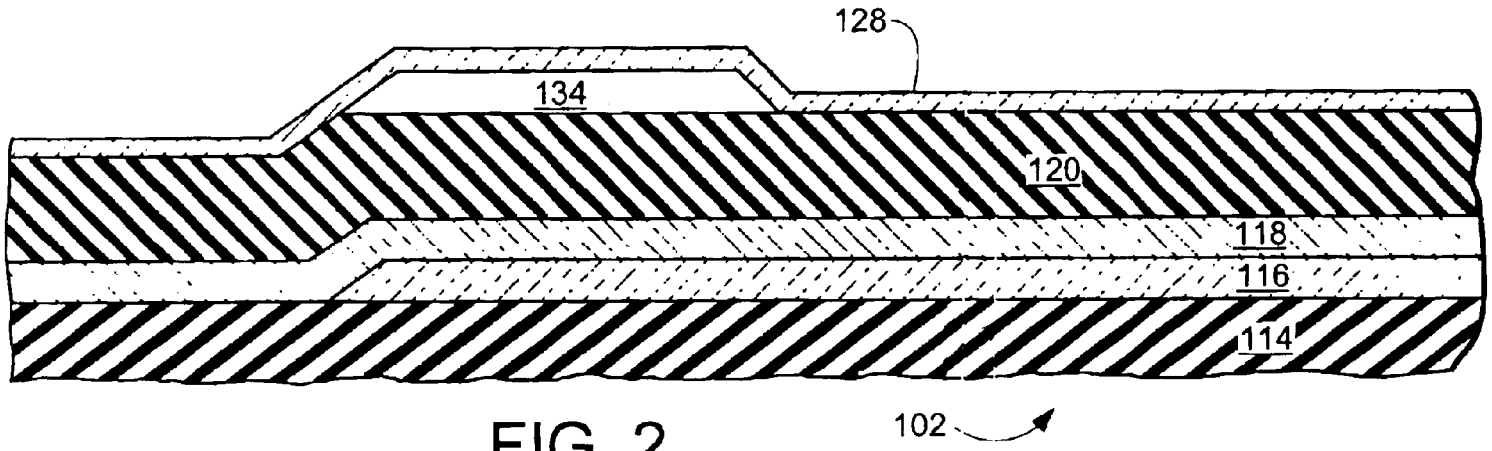
FIG. 2 is a cross-section of a portion of the baseplate of the present invention in an intermediate stage of manufacture.

Referring now to FIG. 2, therein is shown a cross-section of a portion of the baseplate 102 in an intermediate stage of manufacture. A conductor material has been deposited over the insulating plate 114 and has been patterned to form the row electrode 116. The resistive layer 118 has been deposited over the insulating plate 114 and the row electrode 116. The insulating layer 120 has been deposited over the resistive layer 118. A conductor material has been deposited over the insulating layer 120 and patterned to form the column electrode 134. The passivation layer 128 has been deposited on the insulating layer 120 and the column electrode 134. If the passivation layer 128 is of silicon nitride, the insulating layer 120 is of silicon oxide, or vice versa.

Figure 3:
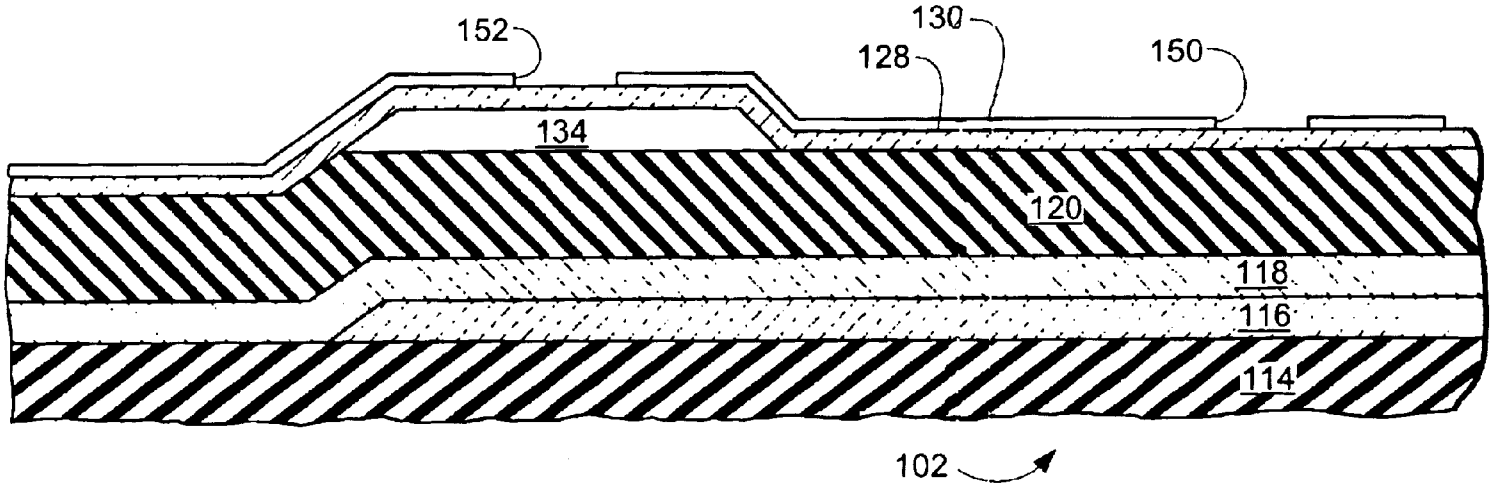
FIG. 3 is the structure of FIG. 2 showing a gate deposited and patterned on the passivation layer.

Referring now to FIG. 3, therein is shown the structure of FIG. 2 having the gate 130 deposited on the passivation layer 128. The gate 130 has been patterned to form a plurality of openings such as concurrently formed openings 150 and 152. It is desired that the concurrently formed openings 150 and 152 be circular holes.

Figure 4:
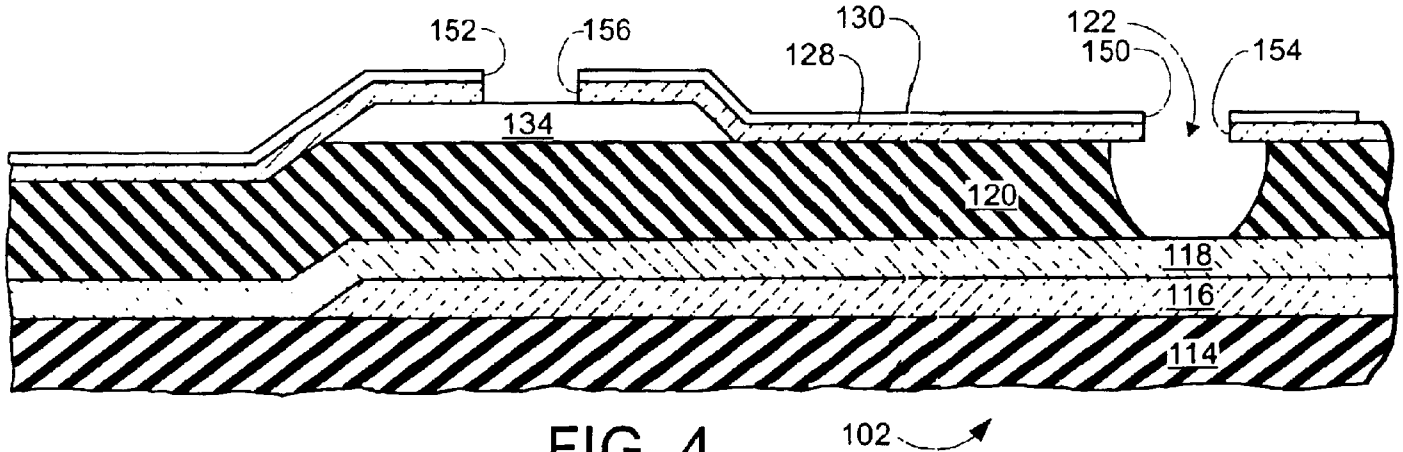
FIG. 4 is the structure of FIG. 3 with openings and an emitter cavity formed in the passivation layer.

Referring now to FIG. 4, therein is shown the structure of FIG. 3 wherein the gate 130 and the openings 150 and 152 therein have been used as a mask to anisotropically etch the passivation layer 128 to form respective concurrently formed openings 154 and 156 therein.

The formation of the concurrently formed openings 154 and 156 does not require a high-selectivity etch. This is because the etching of the concurrently formed opening 154 can extend into the insulating layer 120 and the insulating layer 120 will be removed in a subsequent step. Also, the anisotropic etch of the concurrently formed opening 156 will stop on the column electrode 134.

Also seen in FIG. 4 is the emitter cavity 122, which is formed by the isotropic etching using the concurrently formed openings 150 and 154 of the gate 130 and the passivation layer 128, respectively, as a mask. The column electrode 134 is not etched during the etching of the emitter cavity 122.

Figure 5:
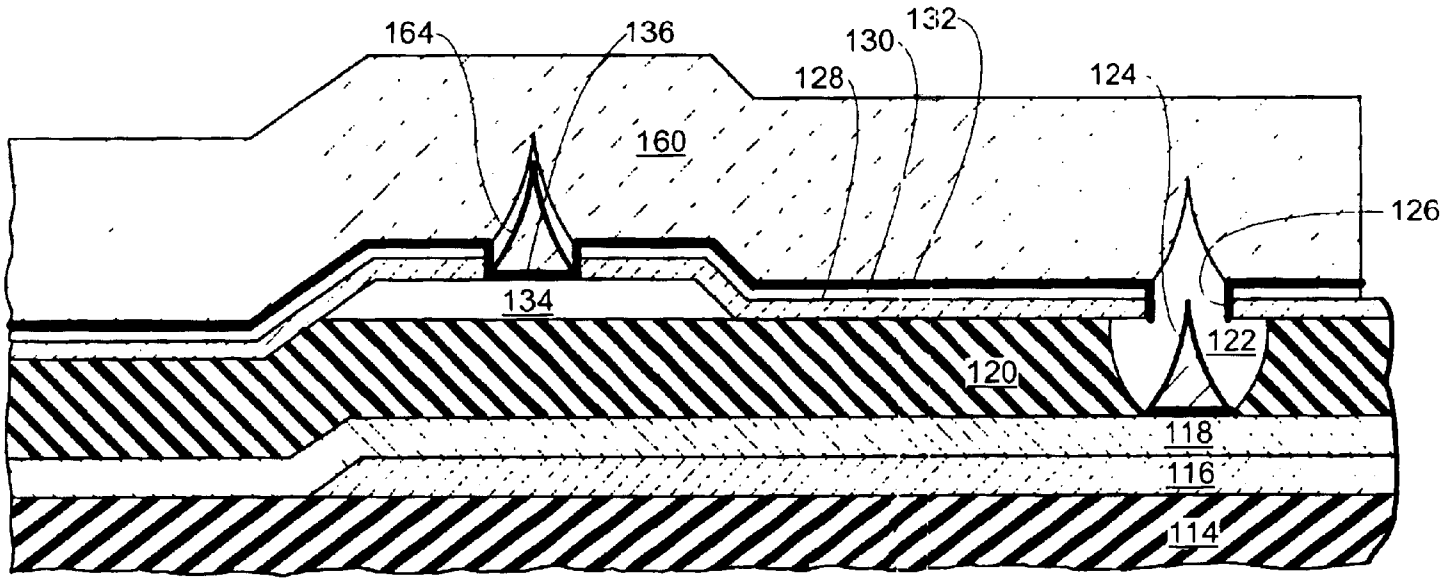
FIG. 5 is the structure of FIG. 4 after deposition of a conductive glue and emitter material layer.

Referring now to FIG. 5, therein is shown the structure of FIG. 4 after deposition of the conductive glue 132. The conductive glue 132 is deposited on the gate 130, in the concurrently formed openings 126, on the resistive layer 118, and on the column electrode 134 where it forms the gate-to-electrode contact 136.

Also shown in FIG. 5, is the deposition of an emitter material layer 160 from which the emitter 124 and an emitter type structure 164 are formed. As the emitter material layer 160 is deposited, the emitter material layer 160 starts to buildup around the concurrently formed openings 126, which causes the emitter 124 and the emitter type structure 164 to be formed in a conical configuration on the conductive glue 132.

After the processing shown in FIG. 5, the emitter material layer 160 and the emitter type structure 164 are removed to form the baseplate 102 shown in FIG. 1.

While the invention has been described in conjunction with a specific best mode, it is to be understood that many alternatives, modifications, and variations will be apparent to those skilled in the art in light of the aforegoing description. Accordingly, it is intended to embrace all such alternatives, modifications, and variations that fall within the spirit and scope of the included claims. All matters set forth herein or shown in the accompanying drawings are to be interpreted in an illustrative and non-limiting sense.

What is claimed is:

1. A flat panel display comprising:

a baseplate;

a faceplate;

a hermetic seal for sealing the baseplate and faceplate;

a first conductive electrode on the baseplate;

a resistive layer over the first conductive electrode;

an emitter on the resistive layer;

a insulating layer on the resistive layer and around the emitter;

a second conductive electrode over the insulating layer;

a passivation layer over the insulating layer and the second conductive electrode, the passivation layer having openings provided therein to expose the emitter and the second conductive electrode;

a gate over the passivation layer having concurrently formed openings provided therein to expose the emitter and the second conductive electrode; and a conductive glue over the gate, the conductive glue extending through one of the concurrently formed openings in the passivation layer and the gate to connect the gate to the second conductive electrode.

2. The flat panel display as claimed in claim 1 wherein the conductive glue bonds the material of the gate and the material of the emitter.

3. The flat panel display as claimed in claim 1 wherein the conductive glue is the same material as the the gate.

4. The flat panel display as claimed in claim 1 wherein the passivation layer is selected from a material selected from a group consisting of silicon nitride and silicon oxide.

5. The flat panel display as claimed in claim 1 wherein the insulating layer is a material selected from a group consisting of silicon nitride and silicon oxide.

6. A flat panel display comprising:

a baseplate;

a faceplate made from a material selected from a group consisting of glass and plastic;

a hermetic seal for sealing the perimeter of the baseplate and faceplate;

a row electrode on the baseplate;

a resistive layer over the row electrode;

an emitter on the resistive layer;

a insulating layer on the resistive layer and around the emitter;

a column electrode over the insulating layer;

a passivation layer over the insulating layer and the column electrode, the passivation layer having openings provided therein to expose thie emitter and the column electrode;

a gate over the passivation layer having concurrently formed openings provided therein to expose the emitter and the column electrode; and a conductive glue over the gate, the conductive glue extending through at least one of the concurrently formed openings in the passivation layer and the gate to connect the gate to the column electrode.

7. The flat panel display as claimed in claim 6 wherein the conductive glue is a material that will sufficiently band the emitter to the resistive layer.

8. The flat panel display as claimed in claim 6 wherein the gate is chromium.

9. The flat panel display as claimed in claim 6 wherein the passivation layer is silicon nitride.

10. The flat panel display as claimed in claim 6 wherein the insulating layer is silicon oxide.

11. A method of manufacturing a flat panel display comprising the steps of:

providing a baseplate;

providing a faceplate;

providing a seal;

hermetically sealing the baseplate to the faceplate;

depositing and forming a row electrode on the baseplate;

depositing a resistive layer over the row electrode;

depositing an insulating layer on the resistive layer;

depositing and forming a column electrode the insulating layer;

depositing a passivation layer over the insulating layer and the column electrode;

depositing a gate over the passivation layer;

concurrently forming openings in the gate to expose the passivation layer;

concurrently forming openings in the passivation layer using the concurrently formed openings in the gate to expose the insulating layer and the column electrode;

isotropically forming an emitter cavity in the insulating layer using an opening in the passivation layer;

depositing a conductive glue over the gate, the conductive glue extending through one of the concurrently formed openings in the passivation layer and the gate to connect the gate to the column electrode;

depositing an emitter material on the baseplate to form an emitter in the emitter cavity in the insulating layer; and removing the emitter material outside of the emitter cavity.

12. The method of manufacturing a flat panel display as claimed in claim 11 wherein depositing the conductive glue deposits a glue which bonds the material of the gate and the material of the emitter.

13. The method of manufacturing a flat panel display as claimed in claim 11 wherein depositing the conductive glue deposits the same material as the gate.

14. The method of manufacturing a flat panel display as claimed in claim 11 wherein depositing the passivation layer deposits a material selected from a group consisting of silicon nitride and silicon oxide.

15. The method of manufacturing a flat panel display as claimed in claim 11 wherein depositing the insulating layer deposits a material selected from a group consisting of silicon nitride and silicon oxide.

16. A method of manufacturing a flat panel display comprising the steps of:

providing a baseplate;

providing a faceplate made from a material selected from a group consisting of glass and plastic;

providing a seal;

hermetically the perimeter of the baseplate to the perimeter of the faceplate using the seal;

depositing and forming a row electrode on the baseplate;

depositing a resistive layer over the row electrode;

depositing an insulating layer on the resistive layer;

depositing and forming a column electrode over the insulating layer;

depositing a passivation layer over the insulating layer and the column electrode;

depositing a gate over the passivation layer;

concurrently forming openings in the gate to expose the passivation layer;

concurrently forming openings in the passivation layer using the concurrently formed openings in the gate to expose the insulating layer and the column electrode;

isotropically forming an emitter cavity in the insulating layer using one of the concurrently formed openings in the passivation layer;

depositing a conductive glue over the gate, the conductive glue extending through at least one of the concurrently formed openings in the passivation layer and the gate to connect the gate to the column electrode;

depositing an emitter material on the baseplate to form an emitter in the emitter cavity in the insulating layer, and removing the emitter material outside of the emitter cavity.

17. The method of manufacturing a flat panel display as claimed in claim 16 wherein depositing the conductive glue deposits chromium.

18. The method of manufacturing a flat panel display as claimed in claim 16 wherein depositing the conductive glue deposits a material that will sufficiently band the emitter to the resistive layer.

19. The method of manufacturing a flat panel display as claimed in claim 16 wherein depositing the passivation layer deposits silicon nitride.

20. The method of manufacturing a flat panel display as claimed in claim 16 wherein depositing the insulating layer deposits silicon oxide.

* * * * *

UNITED STATES PATENT AND TRADEMARK OFFICE

CERTIFICATE OF CORRECTION

PATENT NO. : 6,750,606 B2
DATED : June 15, 2004
INVENTOR(S) : Hidenori Kenmotsu et al.

It is certified that error appears in the above-identified patent and that said Letters Patent is hereby corrected as shown below:

Column 5,
Lines 3 and 38, “a insulating” should read -- an insulating --.
Line 43, “thie,” should read -- the --.

Column 6,
Line 46, “hermetically the” should read -- hermetically sealing the --.

Signed and Sealed this

First Day of February, 2005

JON W. DUDAS
*Director of the United States Patent and Trademark Office*